US005717416A

United States Patent [19]

Chakrabarti

[11] Patent Number: 5,717,416

[45] Date of Patent: Feb. 10, 1998

[54] THREE-DIMENSIONAL DISPLAY APPARATUS

[75] Inventor: Swapan Chakrabarti, Lawrence, Kans.

[73] Assignee: The University of Kansas, Lawrence, Kans.

[21] Appl. No.: 420,055

[22] Filed: Apr. 11, 1995

[51] Int. Cl.[6] ..... G09G 3/00

[52] U.S. Cl. ..... 345/31; 345/44

[58] Field of Search ..... 345/110, 31, 44, 345/46, 30; 362/269, 285, 287, 35

[56] References Cited

U.S. PATENT DOCUMENTS 2,810,318 10/1957 Dockhorn .
3,079,959 3/1963 Johnston .
3,555,349 1/1971 Munz .
3,891,305 6/1975 Fader .
3,970,361 7/1976 Di Matteo et al. .
4,472,737 9/1984 Iwasaki .
4,670,744 6/1987 Buzak .
5,003,444 3/1991 Secka et al. .
5,057,827 10/1991 Nobile et al. ..... 345/31
5,067,167 11/1991 Berger .
5,161,054 11/1992 Williams, Jr. et al. .
5,172,266 12/1992 Garcia et al. .
5,257,086 10/1993 Fateley et al. .
5,455,196 10/1995 Frazier .

*Primary Examiner*—Regina D. Liang
*Attorney, Agent, or Firm*—Hovey, Williams, Timmons & Collins

[57] ABSTRACT

A display apparatus operable for displaying actual three-dimensional moving images is provided. The display apparatus includes a stepper motor having an elongated rotatable shaft, a plurality of display structures spaced along the length of the rotatable shaft, each of the display structures including a light-emitting element, and a control assembly for controlling the illumination of the light-emitting elements of the respective display structures for generating three-dimensional displays of moving images thereon.

8 Claims, 5 Drawing Sheets

THREE-DIMENSIONAL DISPLAY APPARATUS

BACKGROUND OF THE INVENTION

1. Field of the Invention

The present invention relates to video display screens, and more particularly to a video display screen operable for displaying three-dimensional moving images.

2. Description of the Prior Art

It is often desirable to generate and display three-dimensional images for improving the visual affects of movies, video games, computer graphics, and radar imaging devices. Numerous devices and methods have been developed to display three-dimensional images. For example, conventional two-dimensional display screens such as television sets attempt to give the illusion of three-dimensional viewing by using intensity modulation techniques and perspective views. These devices and techniques are not satisfactory for many video applications because they are merely two-dimensional displays that lack the realism of actual three-dimensional images.

Other types of prior art display devices use specially-designed "three-dimensional" glasses or stereo vision glasses for simulating three-dimensional images on a two-dimensional display screen. These devices are also unsatisfactory for many video applications because they merely give the illusion of three-dimensional images. Additionally, the viewing glasses are cumbersome, especially for those who wear vision correcting eyewear, and thus detract from the viewing experience.

Vibrating mirrors and multiple, stacked two-dimensional screens have also been used to display three-dimensional images. While both of these types of devices create actual three-dimensional displays, they have not been commercially successful because of high costs, poor reliability and poor resolution.

Accordingly, there is a need for a three-dimensional display device that overcomes the limitations of the prior art. More particularly, there is a need for an improved three-dimensional display device that provides a high resolution display of actual three-dimensional images while being reliable and cost effective to manufacture.

SUMMARY OF THE INVENTION

The present invention overcomes the problems outlined above and provides an improved three-dimensional display apparatus. More particularly, the present invention provides a display apparatus that is operable for displaying actual three-dimensional moving images while being reliable and cost effective to manufacture.

The display apparatus of the present invention broadly includes a stepper motor having an elongated rotatable shaft, a plurality of display structures spaced along the length of the rotatable shaft, each of the display structures including a plurality of light-emitting elements, and a control assembly for controlling the illumination of the light-emitting elements for generating three-dimensional displays of moving images on the display structures.

The stepper motor includes an elongated rotatable shaft that can be rotated at an angular speed of at least 3600 RPM. The stepper motor is operable for simultaneously rotating all of the display structures about a central axis extending along the length of the shaft.

The display structures are attached and spaced along the length of the rotatable shaft at different depth locations relative to the front of the display apparatus. The display structures are also angularly displaced along the rotatable shaft so as not to overlap. In this way, all of the display structures can be viewed simultaneously from the front of the display apparatus.

One embodiment of the invention includes a plurality of light emitting diodes (LEDs) positioned on each of the display structures and a control assembly for controlling the activation of the LEDs. The control assembly activates the LEDs in pre-selected patterns for generating and displaying three-dimensional moving images on the display structures. The control assembly includes a computer and control circuitry operable for generating activating signals for activating the LEDs on the display structures in three-dimensional patterns.

In a second embodiment of the invention, each of the display structures includes a wedge-shaped CRT screen having a plurality of pixels. The wedge-shaped CRT screens are preferably formed from a single circular CRT screen divided into a plurality of wedge-shaped display structures. A control assembly controls the illumination of the pixels on each display structure for generating and displaying three-dimensional moving images thereon. The control assembly includes a computer operable for receiving or generating control signals representative of three-dimensional moving images and an electron gun operable for scanning the pixels on the display screens in response to the control signals.

In operation, both embodiments of the display apparatus are operable for generating and displaying three-dimensional moving images. The stepper motor simultaneously rotates all of the display structures at a preselected speed about their common axis of rotation. Since the display screens are rotated in unison, each LED or pixel on the display structures can be seen over its entire circle of rotation. The control assembly generates three-dimensional images on the display structures by illuminating the rotating LEDs or pixels on the display structures in pre-selected patterns or in patterns provided by imaging devices such as medical scanners.

BRIEF DESCRIPTION OF THE DRAWING FIGURES

A preferred embodiment of the present invention is described in detail below with reference to the attached drawing figures, wherein.

Figures 11, 11A, 11B:
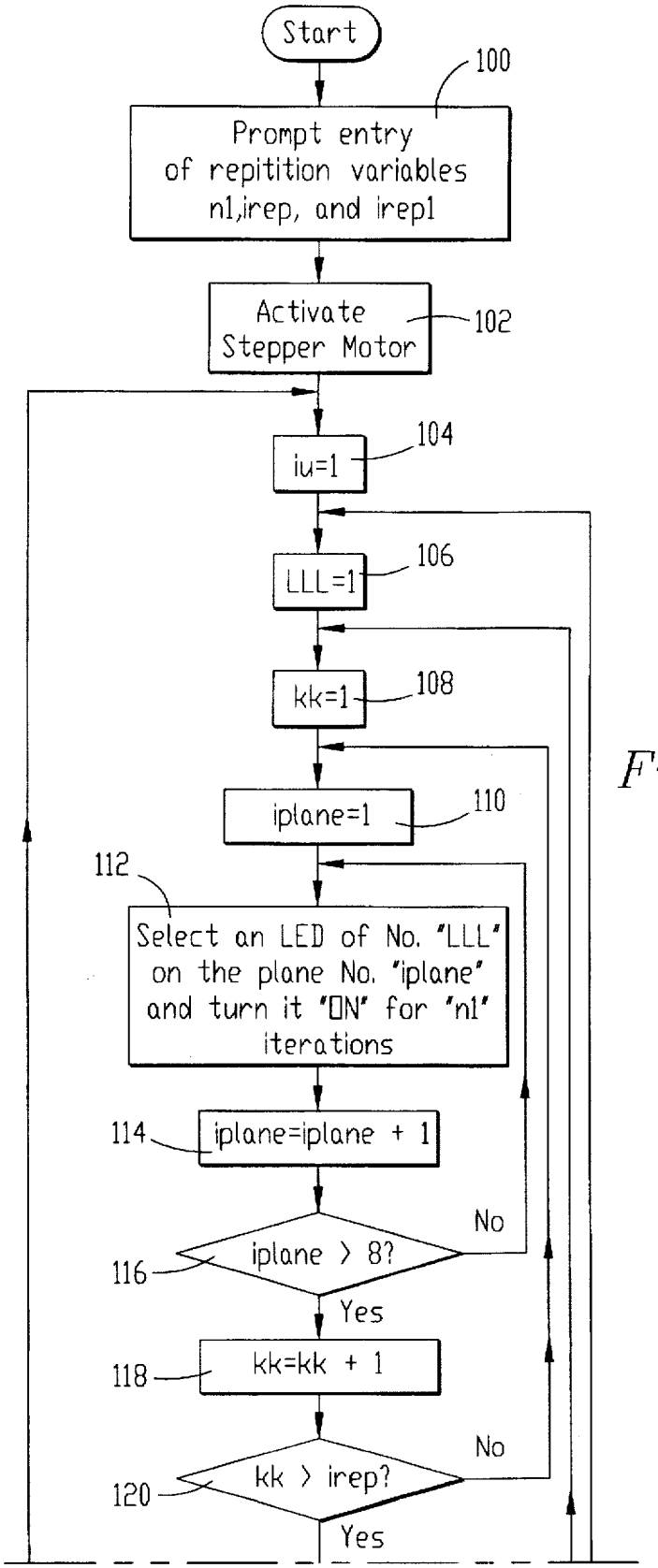
Figure 11B:
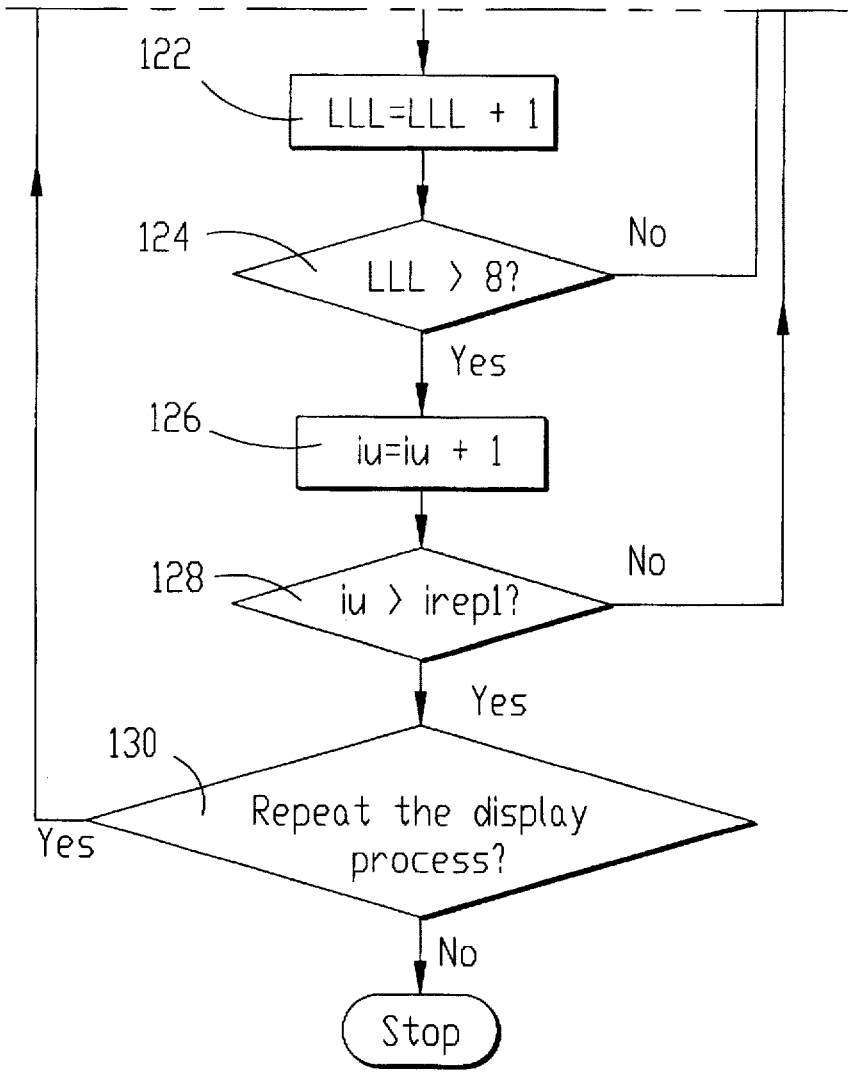

FIG. 11*a* is a flow diagram of a computer program for operating the control assembly of the display apparatus; and FIG. 11*b* is a continuation of the flow diagram illustrated in FIG. 11*a*.

DETAILED DESCRIPTION OF THE PREFERRED EMBODIMENTS

Figures 6, 7, 8, 9, 10:
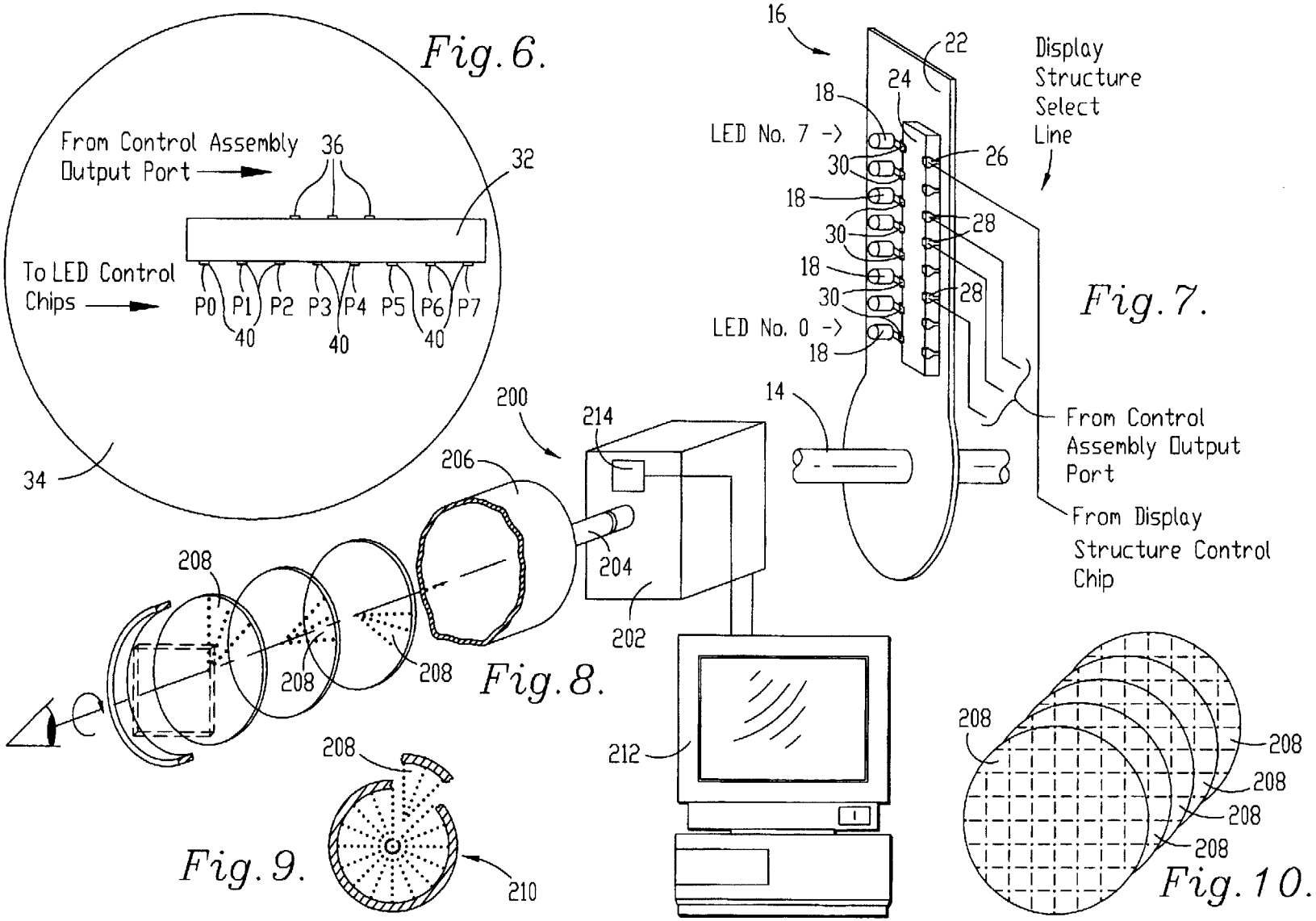
FIG. 6 is a schematic diagram of the display structure decoder circuit.
FIG. 7 is a schematic diagram of an LED control chip coupled with the output port of a control assembly.
FIG. 8 is a side perspective view of a display apparatus constructed in accordance with a second embodiment of the invention.
FIG. 9 is a schematic diagram of a circular CRT screen divided into a plurality of display structures for the apparatus illustrated in FIG. 8.
FIG. 10 is a schematic diagram of a plurality of rotating display structures illustrating the placement of pixels during the rotation of the display structures.

Referring to the drawings, FIGS. 1–7 illustrate a first embodiment of the display apparatus of the present invention and FIGS. 8–10 illustrate a second embodiment of the invention. Returning to FIG. 1, display apparatus 10 of the first embodiment broadly includes motor 12 having elongated rotatable shaft 14, a plurality of display structures 16 spaced along the length of rotatable shaft 14, and control assembly 20 operable for generating and displaying three-dimensional images on display structures 16.

In more detail, motor 12 is preferably a conventional 120 volt AC stepper motor such as the Super Vexta, Model No. UPH299H-AA, manufactured by Oriental Motor Company Limited. Motor 12 includes an elongated rotatable shaft 14 that can be rotated at an angular speed of approximately 3600 revolutions per minute (RPM). Motor 12 is coupled with a conventional power source and is operable for rotating display structures 16 as described below.

Display structures 16 are attached and spaced along the length of the rotatable shaft 14 at different depth locations relative to the front of display apparatus 10. Display apparatus 10 preferably includes eight display structures spaced at approximately 1 inch intervals along the length of rotatable shaft 14. Those skilled in the art will appreciate that any number of display structures 16 can be provided. For example, a greater number of display structures may be provided for applications requiring a high degree of video resolution. Conversely, a lesser number of display structures may be provided for applications requiring less resolution to decrease the overall costs of the display apparatus.

Figures 2, 3, 4, 5:
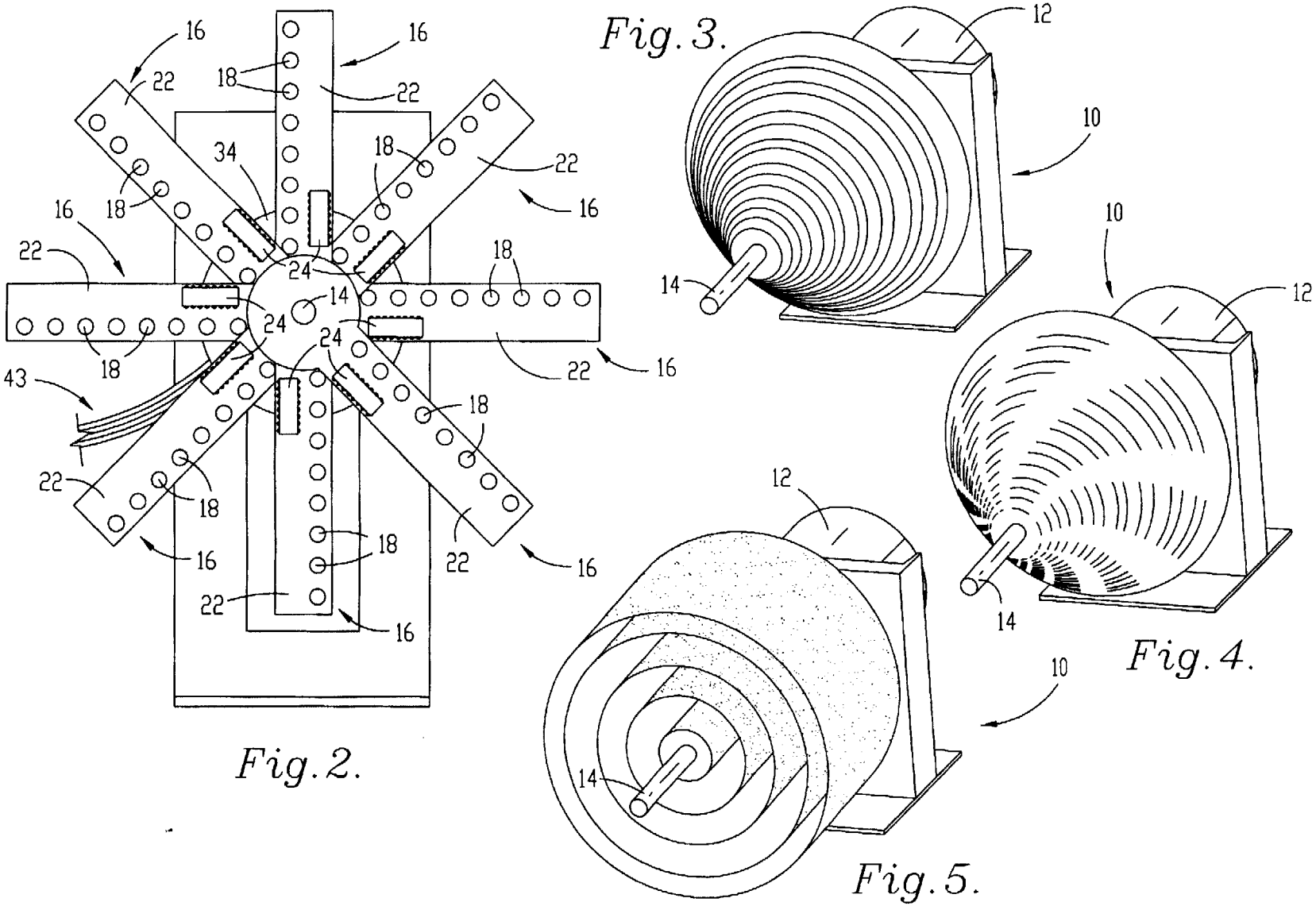
FIG. 2 is a front view of the display apparatus.
FIG. 3 is a front perspective view of the display apparatus in operation illustrating a three-dimensional display.
FIG. 4 is a front perspective view of a display apparatus in operation illustrating a second three-dimensional display.
FIG. 5 is a front perspective view of the display apparatus in operation illustrating a third three-dimensional display.

As illustrated in FIG. 2, display structures 16 are also angularly displaced along the rotatable shaft 14 so as not to overlap. In this way, all of the display structures can be viewed simultaneously from the front of display apparatus 10. Display structures 16 are fixed to rotatable shaft 14 so that they simultaneously rotate about an axis extending along the length of the shaft when stepper motor 12 is in operation.

Each display structure 16 is substantially identical and includes circuit board 22, a plurality of light emitting diodes (LEDs) 18 and LED control chip 24. Circuit board 22 supports the other components of display structure 16 and includes a circular shaft-receiving portion and an elongated shank extending therefrom. The circular portion includes a central aperture sized for sliding over and engaging rotatable shaft 14.

LEDs 18 are spaced along the length of the shank portion of circuit board 22. Each display structure 16 preferably includes eight LEDs 18. Accordingly, display apparatus 10 preferably includes 64 LEDs; however, those skilled in the art will appreciate that any number of LEDs may be provided. LEDs 18 are positioned along the length of their respective display structures 16 so that all 64 LEDs are visible from the front of display apparatus 10 (see FIG. 2).

LED control chip 24 is positioned on circuit board 22 and is electrically coupled between its associated LEDs 18 and control assembly 20. LED control chip 24 is operable for activating any one of the eight LEDs 18 on its display structure 16 in response to control signals from control assembly 20. LED control chip is preferably a 3×8 decoder chip such as Model No. DM741S138NN manufactured by National Semiconductor Company.

As illustrated schematically in FIG. 7, LED control chip 24 includes display structure select terminal 26, three input terminals 28 and eight output terminals 30. Display structure select terminal 26 is coupled to display structure control chip 32 as described in more detail below. The three input terminals 28 are coupled with the output port of control assembly 20. The eight output terminals 30 are coupled with the eight LEDs 18 of their respective display structure 16. As described in more detail below, the input terminals 28 of each LED control chip 24 receive a rapid succession of binary coded control signals from control assembly 20. Each LED control chip 24 decodes the binary control signals and selectively activates any one of the eight LEDs 18 in response thereto.

Since all eight LED control chips receive control signals from control assembly 20, only one display structure is activated at a time. Display structure control chip 32 determines which display structure 16 will be activated at a particular time. As illustrated schematically in FIG. 6, display structure control chip 32 is coupled between control assembly 20 and each of the eight LED control chips 24. Display structure control chip 32 receives control signals from control assembly 20, decodes the control signals and selectively activates any one of LED control chips 24 in response thereto. Display structure control chip 32 is preferably mounted on circular disk 34 attached to rotatable shaft 14 (see FIG. 1).

Display structure control chip 32 is preferably a3×8 decoder chip such as Model No. DM741S138NN manufactured by National Semiconductor Company. As illustrated in FIG. 6, display control chip 32 includes three input terminals 36 and eight output terminals 40. The three input terminals 36 are coupled with the output port of control assembly 20. The eight output terminals 40 are coupled with the eight LED control chips 24. As described in more detail below, the display control chip input terminals 36 receives a rapid succession of binary coded control signals from control assembly 20. Display structure control chip 32 decodes the control signals and selectively activates any one of the eight LED control chips 24 in response thereto.

Figure 1:
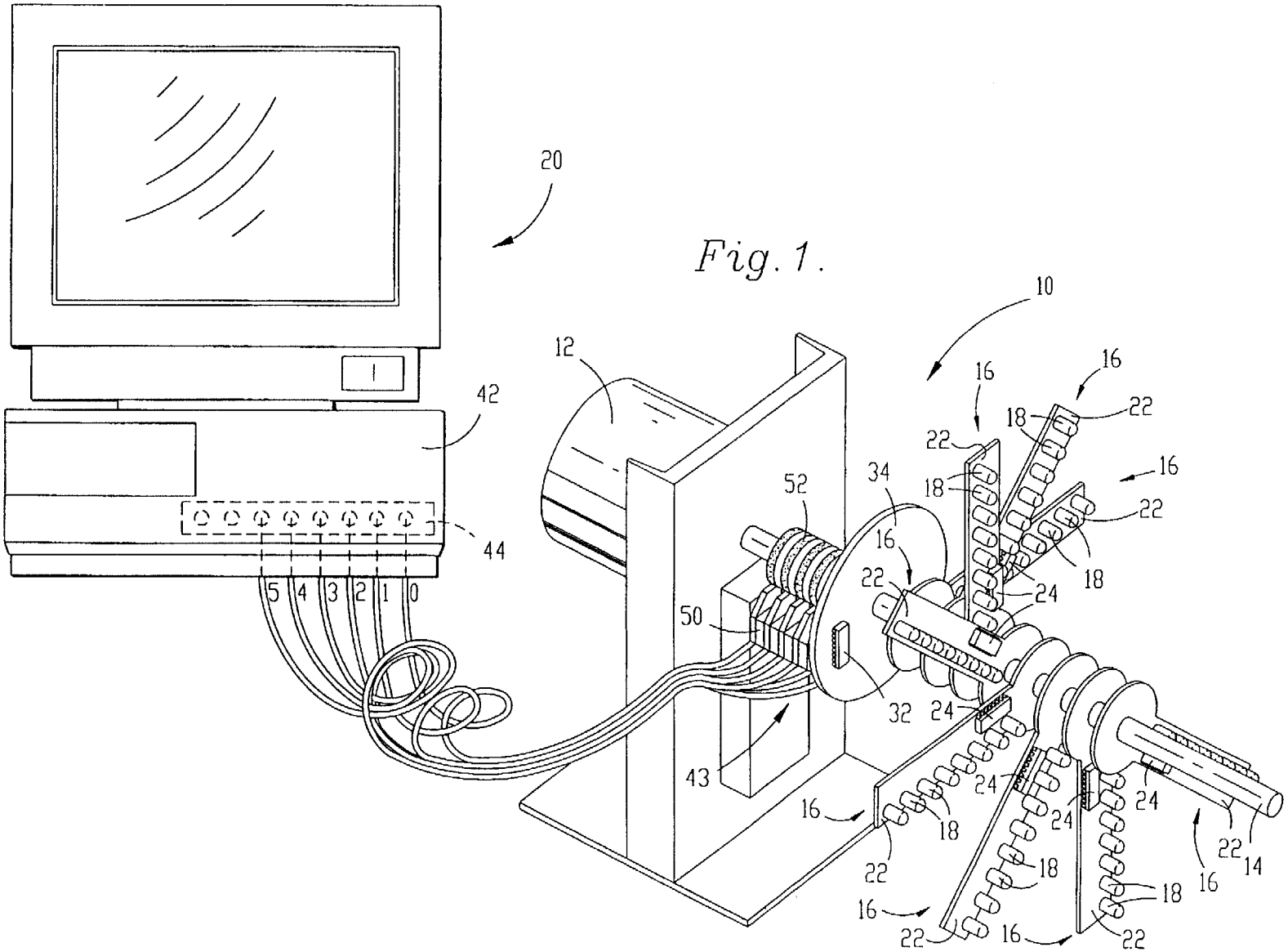
FIG. 1 is a side perspective view of a display apparatus constructed in accordance with a preferred embodiment of the invention.

Control assembly 20 generates and transmits coded binary control signals to the input terminals of LED control chips 24 and display structure control chip 32 for controlling the activation of LEDs 18 on each display structure 16. As best illustrated in FIG. 1, control assembly 20 broadly includes computer 42 and coupling structure 43 for conveying the output signals generate by computer 42 to LED control chips 24 and display structure control chip 32.

Computer 42 is a conventional personal computer such as an IBM compatible microcomputer having a 486 type microprocessor. Computer 42 includes conventional memory and eight-bit parallel output port 44. Computer 42 is operable for generating and transmitting a rapid succession of binary coded control signals to LED control chips 24 and display structure control chip 32 by way of the coupling structure 43. In the preferred embodiment, computer 42 generates a series of six-bit binary numbers. LED control chips 24 and display structure control chip 32 receive and decode these control signals for activating LEDs 18 in patterns to generate three-dimensional images.

Computer 42 is controlled by a computer program that generates the control signals transmitted to the LED control chips 24 and display structure control chip 32. FIGS. 11A and 11B illustrate the steps of one specific computer program for operating computer 42 for developing binary coded control signals. The computer program illustrated in FIGS. 11A and lib creates a rapid succession of binary coded control signals representative of three-dimensional images for displaying three-dimensional cylindrical images on display structures 16 such as those illustrated in FIG. 5.

The computer program is preferably stored in the read-only-memory (ROM) of computer 42 or in a ROM chip mounted on circular disk 34, but may also be stored in the computer hard drive memory or on conventional disks for transfer to the memory of computer 42. The computer program is preferably written in turbo-Pascal; however it can be written in other computer languages as a matter of design choice. The steps of the computer program illustrated in FIGS. 11A and 11B are merely illustrative of one embodiment of the invention and can be modified or adapted to create other three-dimensional images.

Referring to FIG. 11A, the preferred computer program enters at step 100 which prompts the user to enter various input variables including the number of iterations or program loops that the LEDs 18 will be activated (n1), the number of times a specific three-dimensional cylinder will be displayed (irep), and the number of times all of the cylinders will be displayed (irep1). The program next moves to step 102 which activates stepper motor 12 and makes the motor rotate at a constant speed.

Steps 104, 106, 108, and 110 set a number of comparison variables including iu, kk, iplane, and LLL equal to 1. Step 112 develops a six-bit coded binary number that activates LED number "LLL" on display structure number "iplane" for "n1" iterations.

Step 114 then increments the comparison variable iplane by 1. Step 116 asks whether iplane is greater than 8 (the number of display structures). If the answer to step 116 is no, the program returns to step 112 which develops a new six-bit coded binary number that activates LED number "LLL" on the next display structure number "iplane" for "n1" iterations. This loop is continued until iplane is incremented to a number greater than 8. In other words, this loop is continued until LED number "LLL" on each display structure is activated.

If the answer to step 116 is yes, step 118 increments the comparison variable kk by 1. Step 120 asks whether the comparison variable kk is greater than the input variable irep. If the answer is no, the program returns to step 110 where iplane is set to 1. The program then repeats the loop including step 112 to activate LED number "LLL" on each display structure.

If the answer to step 120 is yes, the program continues to step 122 (see FIG. 11B) which increments LLL by 1. Step 124 then asks whether LLL is greater than 8. If the answer is no, the program returns to step 108 where kk is reset to 1. The program then repeats the above described loops until all eight LEDs on all eight display structures have been activated for n1 iterations.

If the answer to step 124 is yes, the program advances to step 126 where the variable iu is incremented by 1. Step 128 then asks whether iu is greater than irep1. If the answer is no, the program returns to step 106 where LLL is reset to 1. The program then repeats the above described loops until all of the cylinders are displayed a number of times equal to then input variable irep.

If the answer to step 128 is yes, the program continues to step 130 which asks whether the users wishes to repeat the display process. If the answer is no, the program exits. If the answer is yes, the program returns to step 104 and repeats all of the above described program loops.

In operation, the above described computer program operates computer 42 for creating a rapid succession of six-bit binary coded numbers. The six-bit numbers are present at output port 44 for delivery to LED control chips 24 and display structure control chip 32. Control chips 24 and 32 illuminate LEDs 18 on each display structure 16 in response to the control signals. The illuminated LEDs create a display of a three-dimensional moving image on the display structures 16. Those skilled in the art will appreciate that the above-described program is merely illustrative of one of many programs that can be written to control the activation of LEDs 18.

Coupling structure 43 conveys the binary coded control signals developed by computer 42 to LED control chips 24 and display structure control chip 32. The preferred coupling structure 43 includes a plurality of carbon brushes 50 and a plurality of corresponding slip rings 52.

As best illustrated in FIG. 1, carbon brushes 50 are coupled to computer output port 44 by a plurality of electrical conductors. An equal number of slip ring 52 are attached to rotatable shaft 14 of stepper motor 12. Carbon brushes 50 are positioned proximate the respective slip rings 52 to make electrical contact with the rotating slip rings 52 to convey electrical signals from computer output port 44 to the slip rings 52.

Slip rings 52 are electrically coupled with input terminals 28 of each LED control chip 24 and input terminals 36 of display structure control chip 32. The three slip rings that are coupled with the three least significant bits of output port 44 are also coupled with the input terminals 28 of each LED control chip 24. The three slip rings that are coupled with the three most significant bits of output port 42 are also coupled with input terminals 36 of display structure control chip 32.

When computer 42 generates a six-bit binary coded number, the three most significant bits are transmitted to input terminals 36 of display structure control chip 32. The eight output terminals 40 of display structure control chip 32 are coupled with the display structure select terminal 26 of each LED control chip 24. Display structure control chip 32 decodes the binary number and selectively activates one of the eight LED control chips 24 in response thereto by transmitting an activation signal to its display structure select terminal 26.

When computer 24 generates a six-bit binary coded number, the three least significant bits are transmitted to input terminals 28 of each of LED control chips 24. The eight output terminals 30 of each LED control chip 24 are coupled with the eight LEDs 18 on the respective display structures 16. If an LED control chip has been activated by display structure control chip 32, the LED control chip decodes the binary number and selectively activates any one of the eight LEDs 18 on its respective display structure.

With the above described configuration, computer 42 can selectively activate LEDs 18 on display structures 16 in three-dimensional patterns by outputting a rapid succession of six-bit binary numbers to LED control chips 24 and display structure control chip 32. The computer program controls the operation of computer 42 to create a rapid succession of six-bit binary coded numbers. The LEDs can be activated and deactivated at a high frequency so that they appear to be continuously on.

In operation, stepper motor 12 rotates display structures 16 so that each LED 18 can be viewed anywhere along its rotational travel. Since display structures 16 are spaced along the length of the rotatable shaft 14, each is located at a different depth location. Computer 42 generates control signals representative of three-dimensional images and selectively activates the LEDs in rapid succession while the display structures are rotating. FIGS. 3, 4 and 5 illustrate sample three-dimensional displays that can be generated on display apparatus.

FIGS. 8, 9 and 10 illustrate a second embodiment of the invention. Referring to FIG. 8, display apparatus 200 of the second embodiment broadly includes stepper motor 202 having rotatable shaft 204, housing 206 coupled with rotatable shaft 204, a plurality of display structures 208 positioned within housing 206, and a control assembly operable for generating and displaying three-dimensional moving images on display structures 208.

Stepper motor 202 is similar to the stepper motor described in the first embodiment of the invention and includes rotatable shaft 204. Housing 206 is preferably an elongated hollow cylinder formed of lightweight synthetic resin material and is coupled with rotatable shaft 204. When activated, stepper motor 202 rotates housing 206 at an angular velocity of 3600 RPM or greater. Rotatable shaft 204 need not be elongated in this second embodiment of the invention.

Display structures 208 are positioned along the interior length of elongated housing 206 and are angularly displaced relative to one another so as not to overlap. When stepper motor 202 is activated, display structures 208 simultaneously rotate about an axis extending along the length of shaft 204. Preferably eight display structures 208 are provided; however, those skilled in the art will appreciate that any number of display structures 208 can be provided. For example, a greater number of display structures 208 may be provided for applications requiring ahigh degree of resolution. Conversely, a lesser number of display structures 208 may be provided for applications requiring less resolution to decrease the overall costs of the display apparatus.

Each display structure 208 is substantially identical and includes a wedge-shape CRT screen having a plurality of pixels. The number of pixels on each display screen depends upon the desired resolution of display apparatus 200. To reduce the weight and cost of display apparatus 200, display structures 208 are preferably formed from a single circular CRT screen 210 divided into eight wedge-shaped display structures See FIG. 9).

The control assembly of the second embodiment includes computer 212 and electron gun 214. As described in more detail below, computer 212 generates or receives control signals representative of three-dimensional moving images and transmits the signals to the electron gun 214. Electron gun 214 scans the pixels on display structures 208 in response to the control signals for illuminating the pixels in the three-dimensional patterns.

Computer 212 is preferably a personal computer such as an IBM compatible microcomputer having a 486 type microprocessor. Computer 212 includes conventional memory and input and output ports. Computer 212 generates control signals representative of three-dimensional moving images for controlling the electron scanning of electron gun 214.

Computer 212 receives data needed to generate the control signals from various sources. For example, in computer graphics and video games, various three-dimensional images are modeled and stored as digital data. Computer 212 receives and processes the digital data for the modeled images to create the control signals. Alternately, in medical or radar imaging applications, three-dimensional coordinate information is generated from the signal received by the imaging device.

Computer 212 computes which pixels are accessible by electron gun 214 at each step angle of stepper motor 202 by considering known information such as the size and number of display structures 208, the number and placement of pixels, and the step angle of stepper motor 202. Using this known information and the data generated by the imaging device, computer 212 generates control signals for controlling the scanning of electron gun 214 to create corresponding moving three-dimensional images on display structures 208.

Electron gun 214 is a high speed CRT scanning device operable for scanning an electron beam across the pixels on each display structure 208 for illuminating the pixels. Electron gun 214 is coupled with computer 212 and scans certain pixels in response to the computer control signals. Since stepper motor 202 rotates display structures 208 each display structure 208 places its pixels over a circular area (see FIG. 10). Thus, each pixel excited by electron gun 214 creates a display of a full circle. Additionally, since each display structure 208 is placed at different depth locations, all pixels within the volume of housing 206 become accessible to electron gun 214 as display structures 208 rotate.

Display structures 208 are preferably rotated at an angular speed of 3600 RPM or greater so that each pixel can be re-excited by electron gun 214 sixty times per second. This refresh rate is sufficient to create an illusion that the pixels are continuously illuminated.

In operation, display apparatus 200 of the second embodiment generates and displays moving three-dimensional displays by illuminating the rotating pixels on display structures 208 in accordance with three-dimensional input data. Display apparatus 200 creates displays of high resolution by using currently available components. For example, currently available electron guns can scan nearly one billion pixels per second. This type of an electron gun can be used to scan 64 spaced display structures each having an array of 512 rows and columns of pixels sixty times per second.

In another embodiment of the invention, the electron gun of the second embodiment can be replaced with a plurality of electron guns mounted to each wedge-shape display structure. The stepper motor rotates each electron gun along with its respective display structure. As a result, the pixels on the display structures will remain fixed relative to the electron gun, and the electron beam will not require continuous refocusing. This will also allow the display structures to operate concurrently since the pixels on several or all of the display structures can be simultaneously illuminated, thus increasing the overall scanning speed of the display apparatus.

Although the invention has been described with reference to the preferred embodiment illustrated in the attached drawing figures, it is noted that equivalents may be employed and substitutions made herein without departing from the scope of the invention as recited in the claims. For example, although the preferred embodiment of the invention includes eight display structures, any number of display structures may be provided. Additionally, the display structures may include any light-emitting elements and may be formed in a variety of shapes and sizes.

In the second embodiment, if the circular screen is divided into N wedge-sections, the three-dimensional display volume will possess N discrete planes. In another embodiment of the invention, the number of virtual display planes can be increased p-times by moving the housing containing the display structures forward-and-backward to p discrete locations in between the original locations of the display structure. In this embodiment, the electron gun will remain stationary, but the housing and the associated stepper motor will be moved with the help of a linear stepper motor. A superconductor-based magnetic levitation technique (known as Meissner Effect) or any other economically feasible existing magnetic levitation technique can be used to reduce the effective mass of the display structures and the rotational stepper motor so that the entire system can be moved easily by the linear stepper motor.

In another embodiment of the invention, only a linear stepper motor can be used to move a single flat circular screen, that is magnetically levitated, forward-and-backward. The electron gun will remain stationary and, as a result, the electron beam needs to be focused on different planes as the screen moves through the different planes of the display system similar to the scheme discussed for the second embodiment of this application. In this embodiment, a three-dimensional view will be generated over a number of planes equal to the number of steps taken by the linear stepper motor.

Having thus described the preferred embodiment of the invention, what is claimed as new and desired to be protected by Letters Patent includes the following:

I claim:

1. A three-dimensional display apparatus comprising;

a motor including an elongated rotatable shaft having a longitudinal axis;

a plurality of display structures axially spaced relative to one another along the longitudinal axis of said shaft and extending radially from said shaft, said display structures being angularly displaced relative to one another along said shaft so as not to substantially overlap, said display structures each including an elongated circuit board having a longitudinal axis and a plurality of light-emitting elements spaced along the longitudinal axis of said circuit board; and control means electrically coupled with said display structures for selectively activating said light-emitting elements during rotation of said shaft so that said display structures display moving three-dimensional images.

2. The display apparatus as set forth in claim 1, said light-emitting elements being light-emitting diodes.

3. The display apparatus as set forth in claim 1, said light-emitting elements being CRT screens having a plurality of pixels thereon.

4. The display apparatus as set forth in claim 3, said display structures being formed from a single flat circular plate of material divided into a plurality of wedge-shaped display structures.

5. The display apparatus as set forth in claim 1, said control means including a computer operable for generating binary coded control signals representative of three-dimensional images.

6. The display apparatus as set forth in claim 1, wherein said light-emitting elements are arranged linearly along the longitudinal axes of their respective circuit boards.

7. A three-dimensional display apparatus comprising:

an elongated rotatable shaft having a longitudinal axis;

a motor operably coupled with said shaft for rotating said shaft;

a plurality of display structures axially spaced relative to one another along the longitudinal axis of said shaft and extending outwardly from said shaft, said display structures being angularly displaced relative to one another along said shaft so as not to substantially overlap, said display structures each including an elongated electrically-conductive support having a longitudinal axis and a plurality of light-emitting elements spaced along the longitudinal axis of said support; and control means electrically coupled with said display structures for selectively activating said light-emitting elements during rotation of said shaft so that said display structures display moving three-dimensional images.

8. The display apparatus as set forth in claim 7, wherein said light-emitting elements are arranged linearly along the longitudinal axes of their respective supports.

* * * * *